US010697033B2

(12) United States Patent
Della Negra et al.

(10) Patent No.: US 10,697,033 B2
(45) Date of Patent: Jun. 30, 2020

(54) DEVICE FOR DELIVERING FILLER MATERIAL INTO A BLAST FURNACE

(71) Applicants: DANIELI & C. OFFICINE MECCANICHE S.P.A., Buttrio (IT); DANIELI CORUS B.V., Velsen-Noord (NL)

(72) Inventors: Angelico Della Negra, Povoletto (IT); Massimiliano Zampa, Udine (IT); Reinoud Jacobus Van Laar, Haarlem (NL); Johannes Pieter Van Ikelen, Ijmuiden (NL)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 190 days.

(21) Appl. No.: 15/748,355

(22) PCT Filed: Jul. 29, 2016

(86) PCT No.: PCT/EP2016/068153

§ 371 (c)(1),
(2) Date: Jan. 29, 2018

(87) PCT Pub. No.: WO2017/017252

PCT Pub. Date: Feb. 2, 2017

(65) Prior Publication Data

US 2018/0216203 A1 Aug. 2, 2018

(30) Foreign Application Priority Data

Jul. 30, 2015 (IT) ..... 102015000040398

(51) Int. Cl.
*C21B 7/20* (2006.01)
*F27B 1/20* (2006.01)

(52) U.S. Cl.
CPC . *C21B 7/20* (2013.01); *F27B 1/20* (2013.01)

(58) Field of Classification Search
CPC ..... C21B 7/20; F27B 1/20
(Continued)

(56) References Cited

U.S. PATENT DOCUMENTS 6,580,744 B1 * 6/2003 Irnich ..... C21B 7/20 373/79
8,701,856 B2 * 4/2014 Tomisaki ..... C21B 7/20 193/16
2012/0148373 A1 * 6/2012 Howell ..... C21B 7/20 414/199

FOREIGN PATENT DOCUMENTS

CN 101173320 A 5/2008
CN 101173321 A 5/2008
(Continued)

OTHER PUBLICATIONS

Patent Cooperation Treaty, International Search Report and Written Opinion for International Application No. PCT/EP2016/068153, dated Sep. 28, 2016, 11 pages.

*Primary Examiner* — Jessee R Roe
*Assistant Examiner* — Michael Aboagye
(74) *Attorney, Agent, or Firm* — Stetina Brunda Garred and Brucker

(57) ABSTRACT

A delivery device for delivering filler material into a blast furnace, comprising:

a housing provided with a transition channel for the filler material which defines a first axis X;

a chute for the filler material arranged underneath said transition channel;

first actuating means, defining a respective second axis A parallel to the first axis X, to actuate a tilt of the chute with respect to the first axis X;

second actuating means, defining a respective third axis B parallel to the first axis X, to actuate a rotation of the chute about said first axis X;

(Continued)

a first annular body inside said housing and coaxial to the first axis X, adapted to translate along the first axis X by means of said first actuating means;

a second annular body inside said housing and coaxial to said first axis X, adapted to translate along the first axis X being coupled to the first annular body and/or adapted to rotate about the first axis X by means of said second actuating means;

a mechanism coupled to the second annular body and to the chute, adapted to convert a translational motion of the second annular body into a tilting movement of the chute with respect to the first axis X, and adapted to convert a rotation motion of the second annular body into a rotation movement of the chute with respect to the first axis X.

18 Claims, 7 Drawing Sheets

(58) Field of Classification Search
USPC ..... 266/197, 199, 46, 241, 193, 274, 184, 266/195; 432/95, 98, 96, 235; 414/160, 414/300, 301, 199, 299, 203–208, 153, 414/152
See application file for complete search history.

(56) References Cited

FOREIGN PATENT DOCUMENTS

| | | | | |
|---|---|---|---|---|
| DE | 2417327 | * | 11/1974 | ..... F27B 1/20 |
| WO | WO2012175335 A1 | | 12/2012 | |

* cited by examiner

DEVICE FOR DELIVERING FILLER MATERIAL INTO A BLAST FURNACE

CROSS-REFERENCE TO RELATED APPLICATIONS

The present application claims priority to PCT International Application No. PCT/EP2016/068153 filed on Jul. 29, 2016, which application claims priority to Italian Patent Application No. 102015000040398 filed Jul. 30, 2015, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a delivery device for delivering filler material into a blast furnace, the device being provided with a chute which can be tilted and rotated with respect to a longitudinal axis.

BRIEF BACKGROUND ART

A blast furnace is typically filled by passing a filler material through an upper opening, or inlet, of the blast furnace. The filler material generally comes from one or more supply tanks placed above, and thus upstream of, the upper opening of the blast furnace.

In order to achieve a good delivery of the material in the blast furnace, the use of a delivery device is known, said delivery device being arranged between the blast furnace inlet and the supply tank outlet. The delivery device is provided with a central supply channel and with a chute arranged downstream of said channel to discharge the filler material. The chute is arranged at the inlet of the blast furnace and can be rotated and tilted during the transition of the filler material.

Document US20120148373 describes a delivery device provided with one or more hydraulic cylinders and with one or more electric motors which are used to tilt and rotate the chute, respectively. The delivery device, defining a longitudinal axis, includes, inside a housing:

an outer ring, which is coaxial to said longitudinal axis, capable of performing a vertical translational movement by means of the hydraulic cylinders;

an inner ring, which is coaxial to said longitudinal axis, coupled to the outer ring by means of a bearing which is designed to allow the inner ring to perform both a vertical translational movement and a rotation movement about the longitudinal axis;

a mechanism coupled to the inner ring and to the chute;

a trunnion, which is coaxial to said longitudinal axis, coupled to the chute and, by means of a toothed bearing, to the pinion of the rotating electric motor.

The chute is tilted by actuating the hydraulic cylinders which move a rod connected to the outer ring which, when vertically translated, generates in turn a vertical translational motion of the inner ring. The mechanism provides for converting the vertical translational motion of the inner ring into a tilting movement of the chute.

The chute rotates by actuating the electric motors, the motion output pinions of which rotate the toothed bearing.

The trunnion is fixed to the toothed bearing, whereby the rotation of the chute is achieved.

A disadvantage of such a delivery device is the arrangement of some of its components.

Indeed, from the periphery of the device to the central supply channel for supplying the filler material, the following components are arranged in sequence: the outer ring; the coupling bearing for the coupling between the outer ring and the inner ring; the inner ring; the hydraulic cylinder and the rod connected thereto, which is at about the same radial distance, with respect to the device axis, as the pinion of the rotating electric motor; the toothed bearing which is at about the same radial distance as the trunnion.

In particular (see FIGS. 6 and 7 of US20120148373), the hydraulic cylinders and electric motors are in an innermost position with respect to the coupling bearing between the outer ring and the inner ring. Moreover, the toothed bearing, which is used to transmit the rotation to the chute, is in an innermost position, having a smaller diameter, with respect to the aforesaid coupling bearing.

Disadvantageously, the position of the hydraulic cylinders and electric motors is at about a half of the radius of the peripheral wall of the housing of the delivery device with respect to the central longitudinal axis. The fact that the rods connected to the respective hydraulic cylinders and the pinion of the electric motor are in a radial position deeply inside the delivery device causes a strong stress acting on the bearings, and in particular on the toothed bearings which transmit the rotation motion. This is mainly because the center of gravity of the delivery device moves from the center of the device itself, when the chute is tilted in a substantially vertical position, to a position outside the circumference defined by the toothed bearing when the chute is tilted towards a horizontal position. The stress is particularly detrimental also because the movement of the center of gravity outside said circumference causes a stress of the bearings, which stress is not homogeneously distributed thereon.

Moreover, the size of the hydraulic cylinders and rotating electric motors, which occupy a considerable space inside the delivery device, does not allow large diameter bearings to be used, the performance of which would be better, and does not allow an optimal cooling.

A further disadvantage is that the pinion of the rotating motor directly acts on the toothed bearing, thus stressing it and contributing to its wear.

Yet another disadvantage is represented by the fastening system of the chute, which may be detached from the delivery device and/or generate detrimental vibrations for the bearings and transmission members during its movement.

The thermal insulation cooperating with the cooling system of the delivery device also achieves limited results.

Therefore, a need to provide a device for delivering filler material into a blast furnace which allows to overcome the aforesaid drawbacks is felt.

SUMMARY OF THE INVENTION

It is an object of the present invention to provide a device for delivering filler material into a blast furnace, in which the arrangement of its components makes simpler and more effective to carry out maintenance.

It is also an object of the present invention to provide a device for delivering filler material into a blast furnace, wherein its components, and in particular its bearings, are subjected to lower stresses, thus having a longer working life than the prior art.

It is a further object of the present invention to provide a delivery device which has a cooling system optimized as compared to the prior art.

It is another object of the present invention to provide a delivery device in which the chute is fixed in a more reliable manner and so as not to generate undesirable vibrations or undesired falls during its movement, while being simple to maintain and easily replaceable.

It is still another object to provide a delivery device which is provided with a better thermal insulation as compared to the prior art.

The present invention relates to a delivery device for delivering filler material into a blast furnace which, in accordance with claim 1, comprises a housing provided with a transition channel for the filler material which defines a first axis X;

a chute for the filler material arranged underneath said transition channel;

first actuating means, defining a respective second axis A parallel to the first axis X, to actuate a tilt of the chute with respect to the first axis X;

second actuating means, defining a respective third axis B parallel to the first axis X, to actuate a rotation of the chute about said first axis X;

a first annular body inside said housing and coaxial to the first axis X, adapted to translate along the first axis X by means of said first actuating means;

a second annular body inside said housing and coaxial to said first axis X, adapted to translate along the first axis X being coupled to the first annular body and/or adapted to rotate about the first axis X by means of said second actuating means;

a mechanism coupled to the second annular body and to the chute, adapted to convert a translational motion of the second annular body into a tilting movement of the chute with respect to the first axis X, and adapted to convert a rotation motion of the second annular body into a rotation movement of the chute with respect to the first axis X, wherein the second annular body is coupled to the first annular body by means of a first bearing which defines a first circumference coaxial to the first axis X, wherein said respective second axis A and said respective third axis B are arranged radially outside the first bearing, whereby the center of gravity of the delivery device is always within said circumference for any position taken by the chute, and wherein the first actuating means and the second actuating means are arranged radially outside the housing.

One of the advantages arising from keeping the center of gravity of the delivery device always within the circumference defined by the first bearing, by means of which the first and second annular bodies are coupled, is a low stress of the device components, thus allowing to obtain a delivery device with a long working life. In particular, the bearing which couples the two rings and the bearing which supports the toothed wheel are not subjected to detrimental stresses.

The radially peripheral arrangement of the tilt actuating means and rotation actuating means advantageously allows to have a wide space inside the housing. For example, the chute tilt actuating means and/or chute rotation actuating means can be radially separate from the housing. Suitable side housings can be provided for the actuating means.

The fact of providing both the tilt actuating means and the rotation actuating means in an external radially position with respect to the housing of the delivery device allows a better and more effective maintenance of the same actuating means, these latter being external to the housing and easily accessible.

Moreover, the available space within the housing allows higher performance bearings to be used. For example, bearings of larger diameter than those of the prior art can be used. Due to the type of bearings which may be used in the device of the invention, the center of gravity of the delivery device, under every operating condition and in every chute position, remains inside the rolling pitch diameter of the rolling bodies of the bearings, and in particular of the coupling bearing between outer ring and inner ring, thus preventing the loads from detrimentally reversing, which would trigger pitting phenomena, in particular of the transmission elements, such as for example the mechanism used to rotate and tilt the chute.

Moreover, the tilt actuating means can be easily disassembled from the central body.

Preferably, the tilt actuating means and rotation actuating means are exclusively hydraulic. This allows a single fluid to be used for all the actuating means.

Advantageously, the increase of the free volume inside the housing allows the installation of a cooling system more effective with respect to the cooling systems of the prior art. The device of the invention preferably provides cooling by substantially using an oil or water, the latter being cheaper than oil, as a cooling fluid. The lubrication of one or more bearings preferably occurs by using a lubricant such as an oil.

It is preferred that the cooling circuit and the lubrication circuit are independent of each other. It is an advantage achieved with this feature to avoid the liquid used for cooling and the liquid used for lubrication from mixing together. For example, when a cooling basin and a pressurized chamber are provided, the cooling liquid remains confined in the annular cooling chamber, or basin, while the lubrication liquid remains confined in the pressurized chamber.

Advantageously, the device of the invention preferably includes a chute locking device, whereby the undesirable fall thereof is avoided, and detrimental vibrations are prevented from being transmitted to the components of the device.

The dependent claims describe preferred embodiments of the invention.

BRIEF DESCRIPTION OF THE DRAWINGS

Further features and advantages of the invention will become more apparent from the detailed description of preferred, but not exclusive, embodiments of a delivery device, shown by way of non-limiting example, with the aid of the accompanying drawings, in which.

The same reference numerals in the figures identify the same elements or components.

DETAILED DESCRIPTION OF AT LEAST ONE PREFERRED EMBODIMENT OF THE INVENTION

Figure 1:
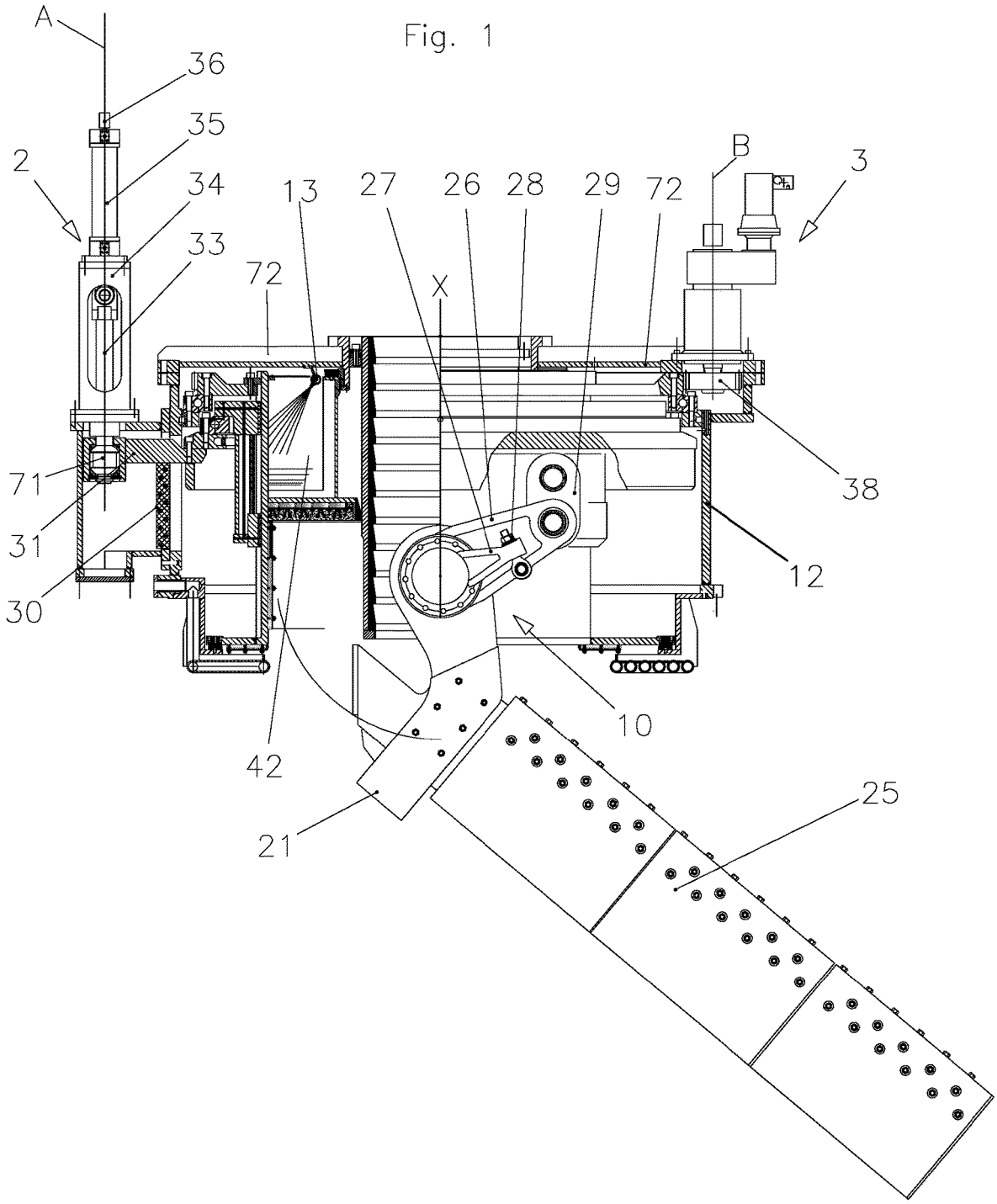
FIG. 1 shows a partially sectional view along a first plane of a device according to the invention.

With reference to the figures, an exemplary embodiment of a delivery device for delivering filler material into a blast furnace (not shown) is disclosed. Such a device is particularly adapted to be installed between the discharge bins and the upper flange of a blast furnace, and serves the function to deliver and layer the filler material according to the process requirements.

The device comprises a housing 12, acting as a supporting structure, which preferably has a substantially cylindrical wall which can be provided with side openings. Housing 12 is provided with a transition channel 1 for the filler material defining a longitudinal axis X. The transition channel 1 is fixed in place and preferably consists of a supporting pipe with a series of rings internally placed close to one another in sequence along axis X, each ring developing perpendicularly to axis X. The rings serves the function to provide a protection against abrasion and direct thermal load, and in particular against the effects of high temperatures on the supporting elements of the device. Housing 12 is closed at the top by a lid 72 which has a central opening for the transition channel 1. A pneumatic seal is typically provided between lid 72 and housing 12, said seal being ensured by a suitable gasket. Similarly, the device is also closed at the bottom. An upper labyrinth seal 15' and a lower labyrinth seal 15 are preferably provided to divide the blast furnace atmosphere and the pressurized chamber 53 of the delivery device. The pressurized chamber 53 (FIG. 2) is substantially defined between the inner wall of housing 12 and the hollow cylindrical body 4, which will be further described below. The seals 15, 15' preferably operate without mechanical contacts, thus allowing only a fraction of pressurizing gas to seep towards the interior of the blast furnace.

The delivery device further comprises a chute 25 for the filler material, arranged underneath the transition channel 1. Chute 25, typically arranged close to the upper flange of a blast furnace, is fixed to a support 21 connected, in turn, to a mechanism 10 adapted to transmit a tilting movement to chute 25 with respect to the first axis X, and adapted to transmit a rotation motion to chute 25 with respect to the first axis X.

The delivery device also comprises first actuating means 2 and second actuating means 3. A plurality of first actuating means 2 and/or second actuating means 3, for example but not being limited to two first actuating means 2 and two second actuating means 3, can be provided. When several first actuating means 2 are provided, they can operate simultaneously or individually, i.e. one at a time. Likewise, when several second actuating means 3 are included, the latter can operate simultaneously or individually.

Figure 1A:
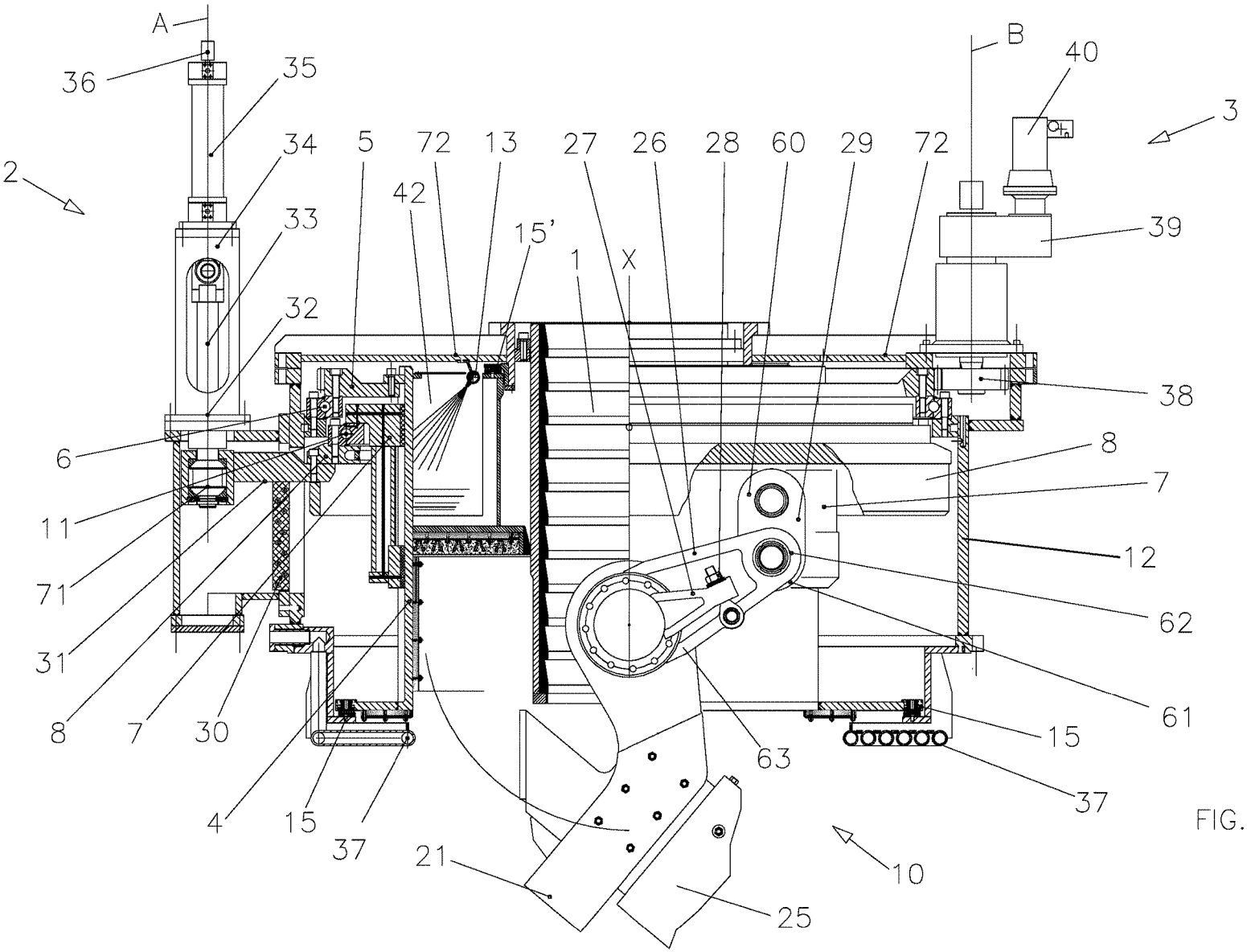
FIG. 1*a* shows an enlargement of part of the view in FIG. 1.

The first actuating means 2 (FIG. 1*a*) define a respective axis A, parallel to axis X, and are used to actuate a tilt of chute 25 with respect to axis X. The first actuating means 2 preferably comprise a hydraulic cylinder 35 provided with a supporting spacer 34 and a piston 33, or connecting shaft, which can be moved along axis A through said supporting spacer 34. Piston 33 is provided with a connecting portion 71 at an end thereof outside the supporting spacer 34. It is preferred that the hydraulic cylinder 35 is also provided with a position transmitter 36, for example arranged at the upper end of the hydraulic cylinder 35, opposite to the end defined by the connecting portion 71.

The second actuating means 3 (FIG. 1*a*) define a respective axis B, parallel to axis X, and are used to actuate a rotation of chute 25 about axis X. The second actuating means 3 preferably comprise a motor 40, e.g. of hydraulic type, a gearbox 39, e.g. a parallel axis gearbox, and an output pinion 38, or transmission pinion.

The device also comprises (FIGS. 1*a* and 2) a first annular body 8 and a second annular body 7, both arranged inside housing 12 and coaxial to axis X.

The first annular body 8, or outer ring, is adapted to translate along axis X by means of the first actuating means 2. The connecting shaft 33 is preferably coupled, by means of its connecting portion 71, to a guide support 31 which is able to slide on a suitable guide 30. Such a guide support 31 is coupled to the first annular body 8 so as to allow it to translate when the first actuating means are operated.

The second annular body 7, or inner ring, is coupled to the first annular body 8 by means of a bearing 11, also referred to as first bearing, which defines a circumference, also referred to as first circumference, which is coaxial to axis X. The second annular body 7 is coupled to the first annular body 8, whereby it is also adapted to translate along axis X. Moreover, the second annular body 7 is also adapted to rotate about axis X by means of the second actuating means 3.

Figure 6:
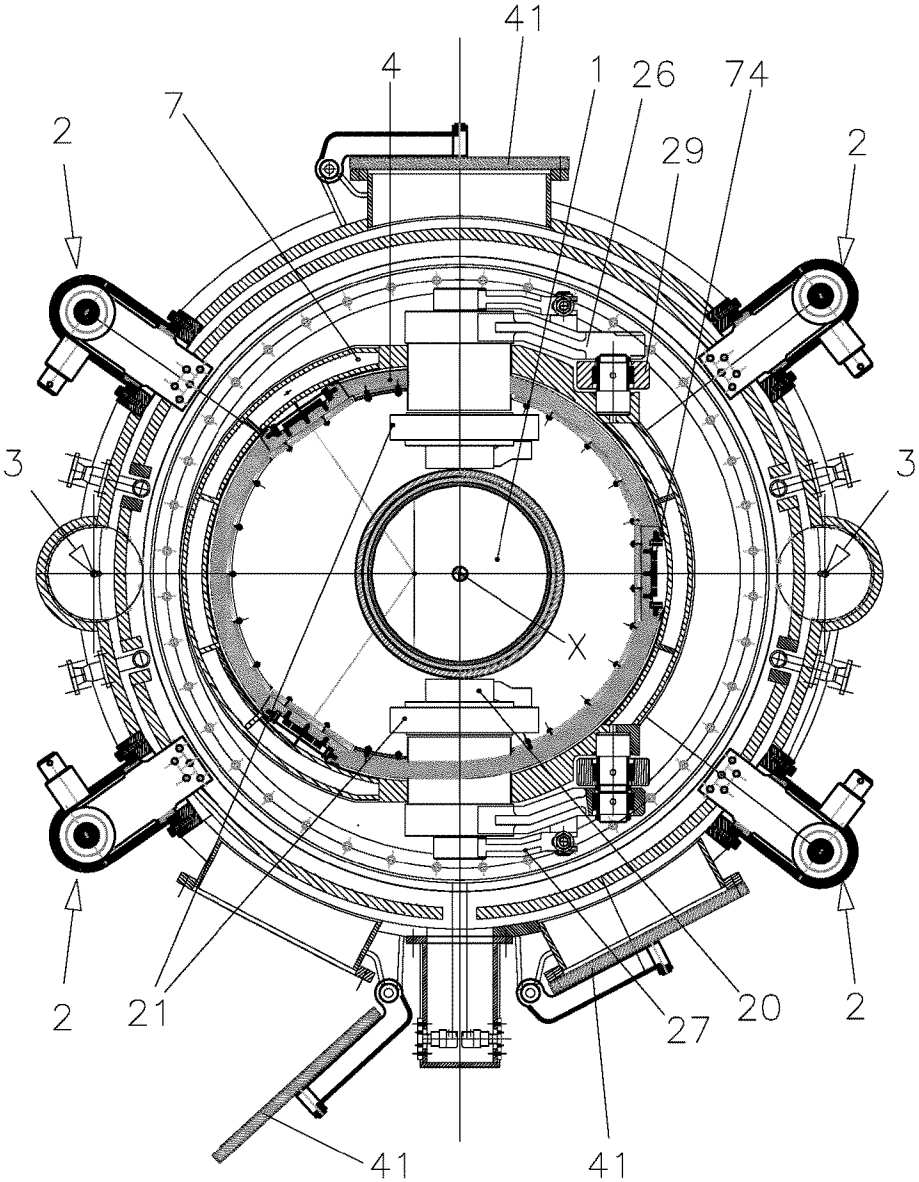
FIG. 6 shows a section of the device in FIG. 1 along a plane perpendicular to axis X.

A hollow cylindrical body 4, coaxial to axis X, is preferably provided, on which the second annular body 7 is externally constrained so as to slide along the cylindrical walls of the hollow cylindrical body 4, and therefore along axis X. For example, the hollow cylindrical body 4 comprises suitable guides 74 (FIG. 6) to allow the second annular body 7 to slide. The hollow cylindrical body 4 is also adapted to rotate about axis X, by operating the actuating means 3, as better described below.

The tilting and/or rotation of chute 25 with respect to axis X occurs by means of mechanism 10 which is coupled to the second annular body 7 and to the support 21 of chute 25. In particular, the mechanism 10 is adapted to convert a translational motion of the second annular body 7 into a tilting movement of chute 25 with respect to axis X, and is also adapted to convert a rotation motion of the second annular body 7 into a rotation movement of chute 25 about axis X.

Mechanism 10 preferably comprises two cranks 29, or connecting swinging supports, hinged to the second annular body 7 at an end 60 thereof, so that the two cranks 29 share the same hinge axis perpendicular to axis X. At the other end 61 of each crank 29, an end 62 of a respective control lever 26 is hinged. The other end 63 of the control lever 26 is integrally fixed to a respective shaft 17, partially shown in FIG. 2, which can rotate about an axis thereof perpendicular to axis X. The two shafts 17 cross the hollow cylindrical body 4, being able to rotate along with it, and the support 21 of chute 25 is integrally fixed to the ends of the two shafts 17 which are proximal to the transition channel 1. Therefore, with particular reference to FIG. 2, mechanism 10 consists of two parts symmetrically arranged with respect to a plane which is perpendicular to the sheet of FIG. 2 and contains axis X, i.e. with respect to a centerline plane of the transition channel 1 containing axis X. Each part of mechanism 10 comprises a crank 29, a control lever 16 and a shaft 17.

Thereby, a downward translation of the second annular body 7 along axis X corresponds to a downward movement of the ends 62 of the control levers 26, which rotate along with the respective shaft 17 about the axis of the latter which is perpendicular to axis X. Such a rotation of the shafts 17 causes support 21 and thus chute 25 to be tilted with respect to axis X.

Moreover, a rotation of the hollow cylindrical body 4 about axis X also corresponds to a rotation of mechanism 10 about axis X, and thus to a rotation of shafts 17, support 21 and thus chute 25 about axis X.

Advantageously, axis A of the first actuating means 2 and axis B of the second actuating means 3 are radially outside the circumference defined by bearing 11. Due to this feature of the invention, the center of gravity of the delivery device is always within such a circumference for any position taken by chute 25.

Preferably, the device also comprises a transmission element 5, such as a toothed wheel, coaxial to axis X, which is used to transmit a rotation from the second actuating means 3 to the second annular body 7. For example, the transmission pinion 38 of each second actuating means 3 can be coupled to the toothed wheel 5.

The transmission element 5 is preferably fixed to the outer cylindrical walls of the hollow cylindrical body 4. The transmission element 5 is supported by an additional bearing 6, also referred to as second bearing, which defines another circumference, also referred to as second circumference, which is coaxial to axis X. Preferably, axis A of the first actuating means 2 and axis B of the second actuating means 3 are radially outside the circumference defined by the second bearing 6. Moreover, the rolling pitch diameter of the rolling bodies of the second bearing 6 is preferably larger than the rolling pitch diameter of the rolling bodies of the first bearing 11.

Advantageously, the first actuating means 2 and the second actuating means 3 are arranged radially outside housing 12. In particular, it is preferred that additional housings are provided to house at least partially the first actuating means 2 and the second actuating means 3. Such additional housings are external, adjacent and in communication with housing 12.

The first actuating means 2 and the second actuating means 3 can be arranged radially completely outside the housing 12, possibly radially external but adjacent to the housing 12 or radially external and separate from the housing 12.

The sealing of the delivery device is ensured, for example, by suitable packing seals between the actuating means 2, 3 and the respective additional housings. However, the sealing of the device is ensured even if suitable outer housings for the actuating means 2, 3 are not included.

In order to give chute 25 an increased stability, a suitable locking device for locking chute 25 is advantageously provided. Such a locking device comprises a pair of elements 20 conveniently shaped, for example substantially L-shaped, adapted to abut against chute 25.

Figure 2:
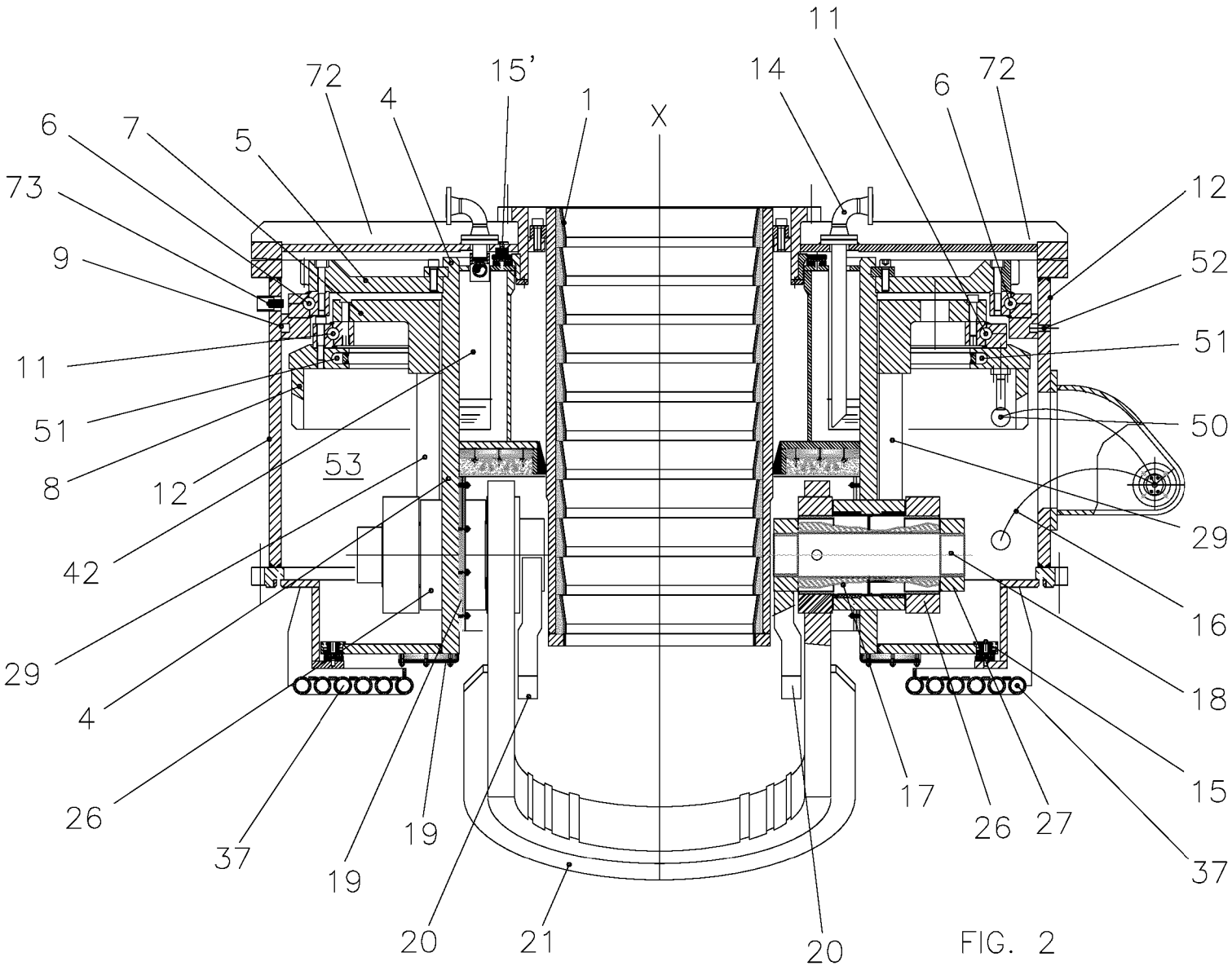
FIG. 2 shows a sectional view along a second plane of the device of the invention.

With particular reference to FIG. 2, the locking device consists of two parts symmetrically arranged with respect to a plane which is perpendicular to the sheet of FIG. 2 and contains axis X, i.e. with respect to the centerline plane of the transition channel 1 containing axis X. Each part of the locking device comprises one element 20 integrally connected to a respective auxiliary shaft 18, which is coaxial to and inside a corresponding shaft 17 and is able to rotate along an axis thereof which is perpendicular to axis X by means of a respective control lever 27. Each control lever 27 is arranged at a respective control lever 26, is integrally keyed onto an end of the auxiliary shaft 18, and is preferably arranged parallel to and outside the respective control lever 26. The movement of the control lever 27 is prevented by mounting a suitable lock nut 28 to a pin which crosses the end of the control lever 27 which is distal from the auxiliary shaft 18, said pin being removably fixed to the control lever 26. For example, on the upper side of said distal end of the control lever 26, the lock nut 28 is mounted to a first end of this pin; on the lower side of said distal end of the control lever 26, a second end of this pin is provided with an eyelet removably fixed to an additional pin or projection which is integral with the control lever 26.

Figure 3:
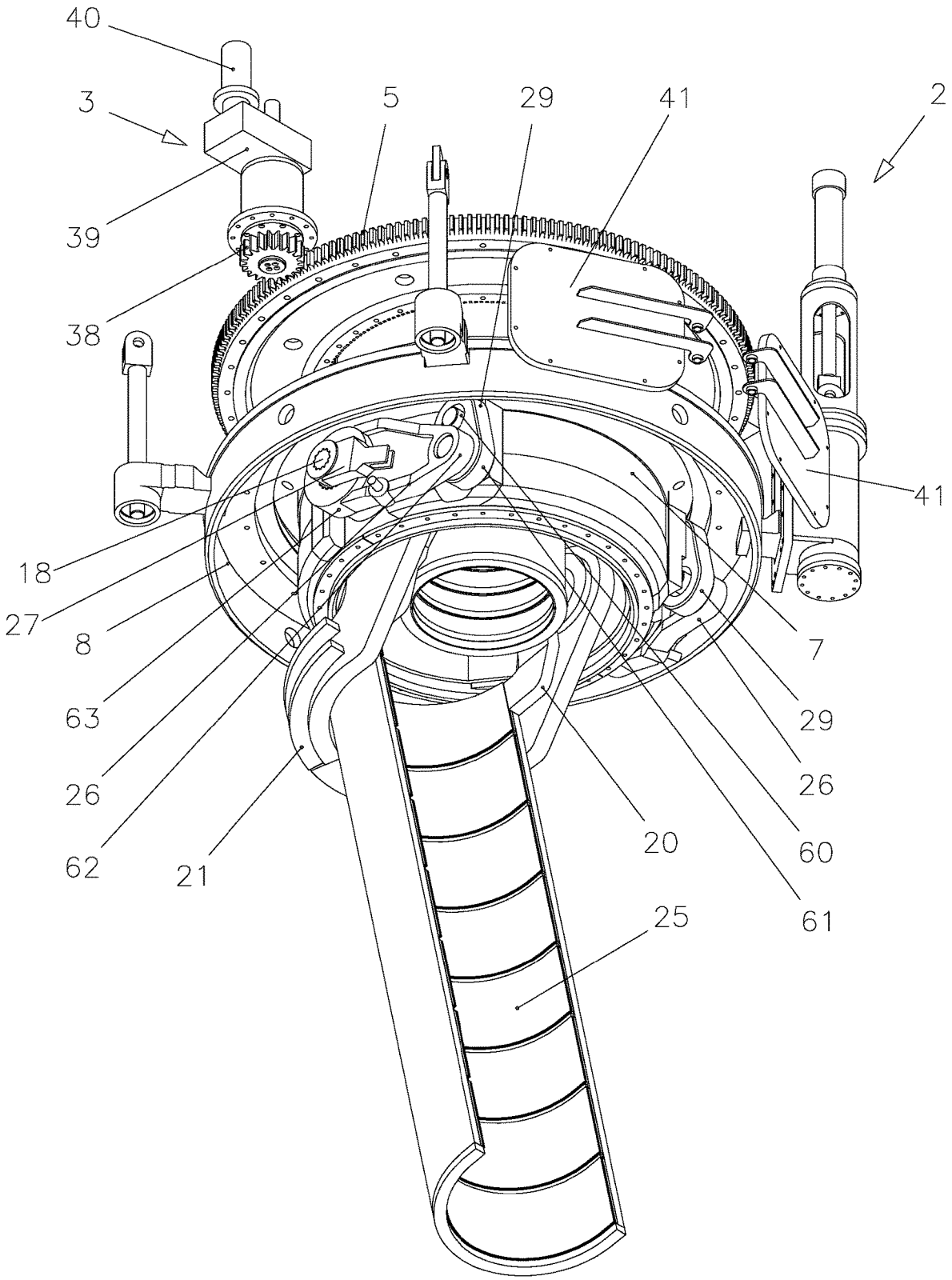
FIG. 3 shows a perspective view of part of the device in FIG. 1 in a first position.
Figure 4:
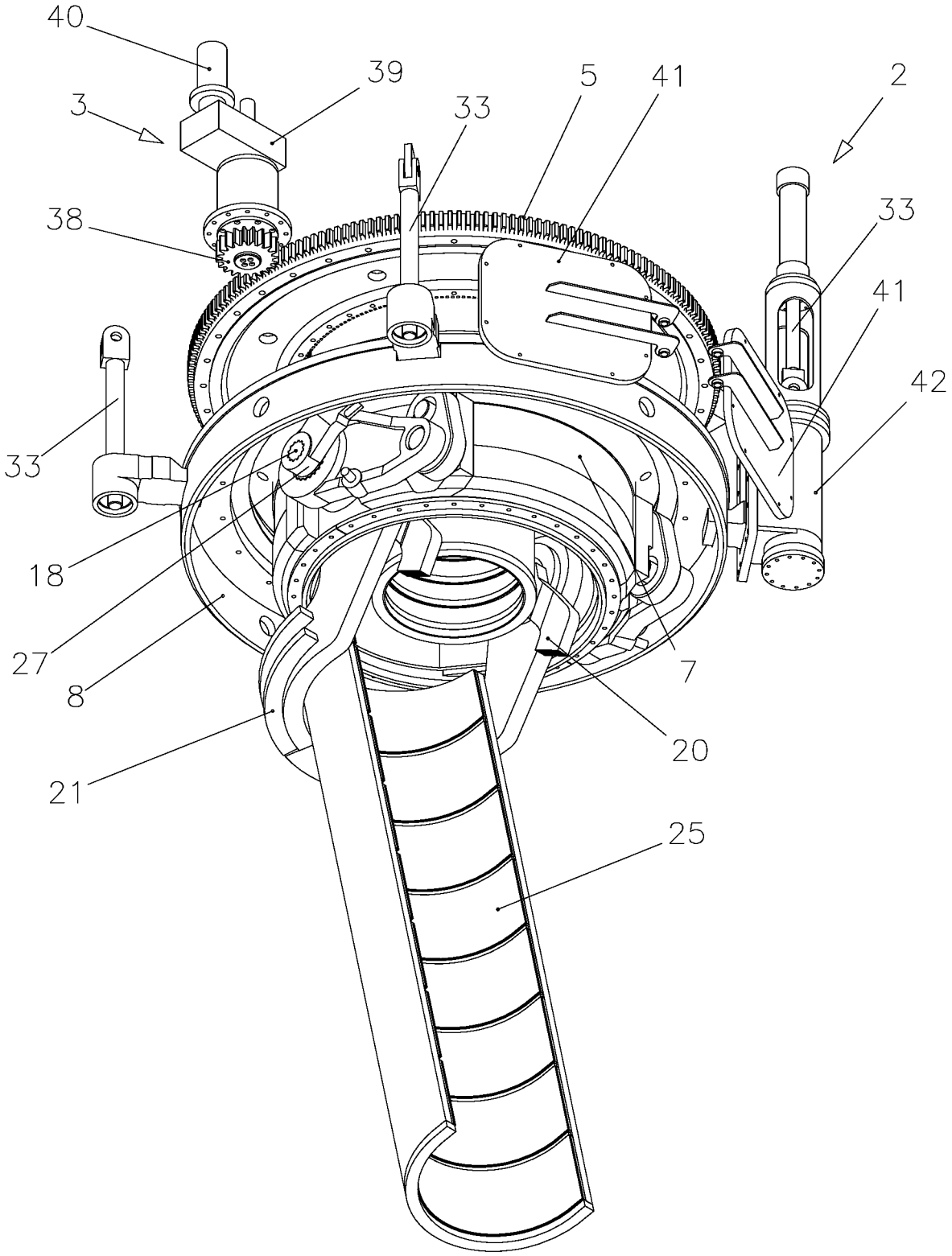
FIG. 4 shows a perspective view of part of the device in FIG. 1 in a second position.
Figure 5:
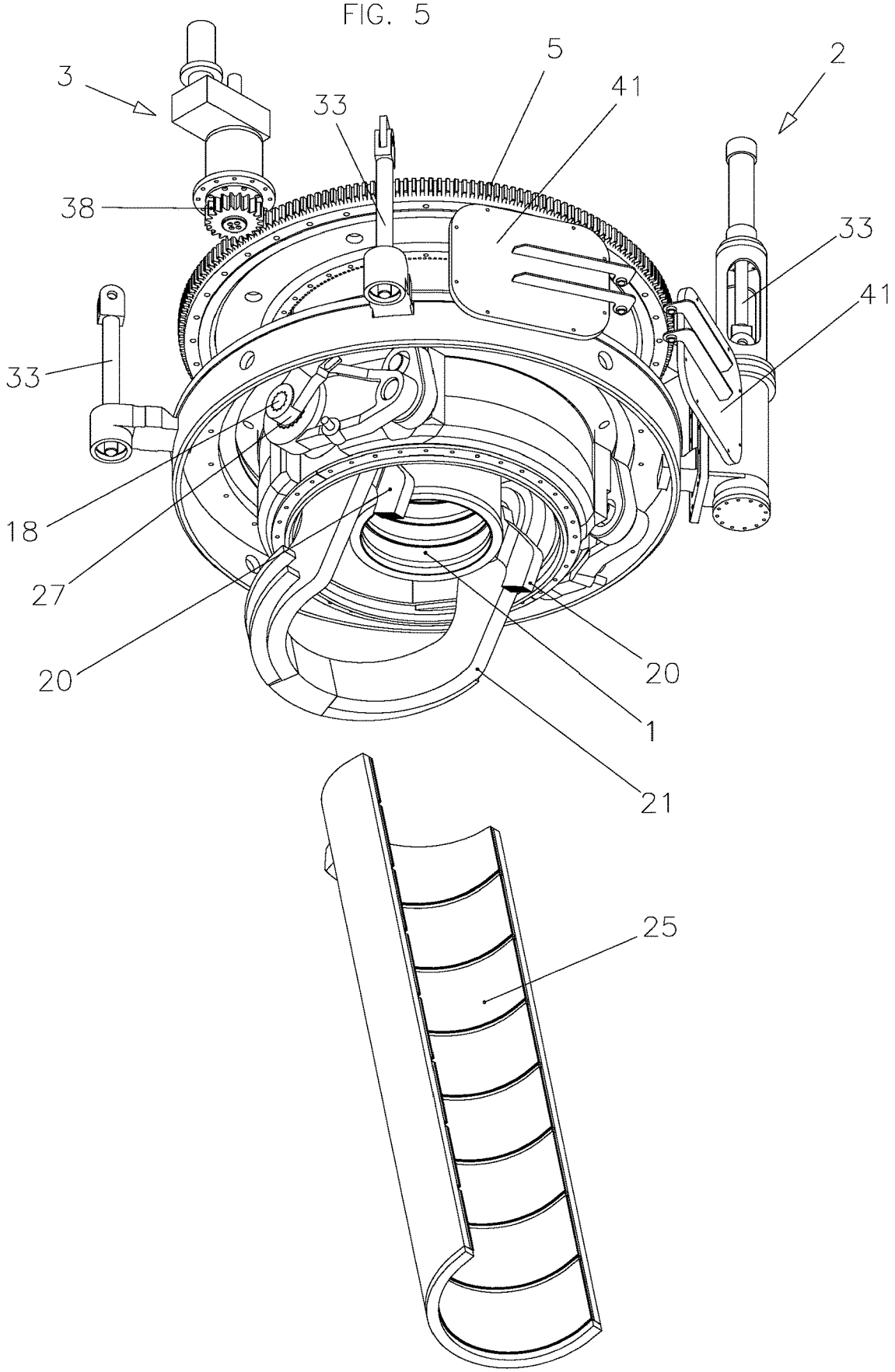
FIG. 5 shows a perspective view of part of the device in FIG. 1 in a third position.

When the elements 20 abut against chute 25, that is in the chute locking position (FIG. 3, for example), the chute is prevented from falling, thus also preventing dangerous vibrations which may damage the bearings and the transmission members of the device from arising.

When chute 25 is intended to be detached, the lock nut 28 and the corresponding eyelet pin are disassembled, and the control lever 27 can be rotated along with the auxiliary shaft 18 so as to rotate the elements 20 which will no longer abut against chute 25.

It is preferred that the delivery device is provided with at least one diagnostic system 73 (FIG. 2) for the bearings, which is based, for example, on the acoustic waves and is capable of providing the residual working life according to predetermined measurement parameters. Moreover, one or more inspections ports 41 can be included (FIGS. 3 to 6).

In a preferred embodiment an annular cooling chamber 42 can be advantageously provided between the hollow cylindrical body 4 and the transition channel 1 (FIGS. 1, 1*a* and 2), said annular cooling chamber 42 being preferably integral with the hollow cylindrical body 4. For example, the annular cooling chamber 42 is defined by the inner cylindrical walls of the hollow cylindrical body 4 and has additional walls, defining said chamber 42, which are fixed to the hollow cylindrical body 4 itself. The annular cooling chamber 42 is internally provided with at least one stationary annular circuit 13, mainly used to cool the hollow cylindrical body 4. Indeed, the stationary annular circuit 13 comprises at least one delivery pipe with a plurality of nozzles which are adapted to spray a cooling liquid on the inner wall, i.e. proximal to the transition channel 1, of the hollow cylindrical body 4. Moreover, since the cooling liquid remains substantially confined in the annular cooling chamber 42, a return pipe 14 is also provided, adapted to take in the cooling liquid accumulated at the bottom of the cooling chamber 42. Preferably, the cooling liquid is water, but it can also be another fluid, such as oil. Moreover, it is preferred that the annular cooling chamber 42 occupies an upper part, distal from chute 25, of the annular space between the hollow cylindrical body 4 and the transition channel 1. In the lower part of said annular space, proximal to chute 25 and separate from the upper part, part of support 21, of mechanism 10 and of chute locking device 25 is accommodated.

It is preferred that the inner part of the hollow cylindrical body 4 at said lower space is coated (FIG. 2) with at least one layer 19 of insulating refractory material with high properties. Thereby, a convenient thermal and anti-corrosion shield is provided, which limits the heat input inside the equipment.

In an alternative embodiment (not shown) the annular cooling chamber 42 is configured to be filled with a cooling liquid, for example water or oil, and there is provided an annular pipe, arranged inside said annular cooling chamber 42, in which a further liquid, having a temperature lower than the temperature of said cooling liquid, is circulated in order to maintain constant the temperature of said cooling liquid. Said annular pipe can be a serpentine pipe. This alternative embodiment allows a direct and uniform cooling of all the inner walls of the device adjacent to the annular cooling chamber 42.

Moreover, an additional dedicated cooling circuit 37 is preferably provided, limiting the thermal flow coming from the gases exiting from the blast furnace. Such a cooling circuit 37 can be detached from the bottom of the delivery device (FIG. 1*a*) or directly in contact with the lower part of the equipment (FIG. 2). Support 21 and chute 25 can also be provided with a convenient insulating refractory coating.

In order to lubricate the first bearing 11, a lubrication circuit is provided. The lubrication circuit preferably comprises a hose 16 which is adapted to be fed with a lubricant, e.g. grease or oil, and crosses housing 12. An end of hose 16 is connected to the first annular body 8. In particular, by means of a rotary joint 50, hose 16 is connected to an annular duct 51 inside the first annular body 8 which is adapted to lead the lubricant to the first bearing 11.

In order to lubricate the second bearing 6, an additional lubrication circuit is preferably provided. It is preferred that such an additional lubrication circuit comprises an opening 52 obtained in the cylindrical side wall of housing 12 in order to introduce a lubricant, e.g. grease or oil, into an additional annular duct 9 which is used to lead the lubricant to the second bearing 6.

The cooling circuit, comprising the annular cooling chamber 42, and the aforesaid lubrications circuits are advantageously independent of one another. In particular, the cooling circuit is separate from the lubrication circuits in order to avoid the liquid used for cooling and the liquid used for lubrication from mixing together.

The invention claimed is:

1. A delivery device for delivering filler material into a blast furnace, comprising:

a housing provided with a transition channel for the filler material, the transition channel being positioned along and defining a first axis X;

a chute for the filler material arranged underneath said transition channel;

a first actuator positioned along and defining a respective second axis A parallel to the first axis X, the first actuator being operative to actuate a tilt of the chute with respect to the first axis X;

a second actuator positioned along and defining a respective third axis B parallel to the first axis X, the second actuator being operative to actuate a rotation of the chute about said first axis X;

a first annular body positioned inside said housing and coaxial to the first axis X, the first annular body being adapted to translate along the first axis X via actuation of the first actuator;

a second annular body positioned inside said housing and coaxial to said first axis X, the second annular body being adapted to translate along the first axis X, being coupled to the first annular body and being adapted to rotate about the first axis X via actuation of the second actuator;

a mechanism coupled to the second annular body and to the chute, the mechanism being adapted to convert a translational motion of the second annular body into a tilting movement of the chute with respect to the first axis X, and being adapted to convert a rotation motion of the second annular body into a rotation movement of the chute with respect to the first axis X;

wherein the second annular body is coupled to the first annular body via a first bearing which defines a first circumference coaxial to the first axis X;

wherein said respective second axis A and said respective third axis B are arranged radially outside the first bearing;

whereby a center of gravity of the delivery device is always within said first circumference for any position taken by the chute; and wherein the first actuator and the second actuator are arranged radially outside the housing.

2. The delivery device according to claim 1, wherein there is provided a transmission element coaxial to the first axis X, said transmission element being operative to transmit a rotation from the second actuator to the second annular body, said transmission element being supported by a second bearing defining a second circumference which is coaxial to the first axis X.

3. The delivery device according to claim 2, wherein said respective second axis A and said respective third axis B are arranged radially outside the second bearing.

4. The delivery device according to claim 2, wherein the first and second bearing comprise rolling bodies, a rolling pitch diameter of the rolling bodies of the second bearing is being larger than a rolling pitch diameter of rolling bodies of the first bearing.

5. The delivery device according to claim 2, wherein there is provided a hollow cylindrical body coaxial to the first axis X, on which the second annular body is externally constrained so as to slide along said first axis X, said transmission element being fixed outside said hollow cylindrical body.

6. The delivery device according to claim 2, wherein said second actuator comprises a motor, a gearbox and an output pinion meshing with a toothed wheel, the toothed wheel defining said transmission element.

7. The delivery device according to claim 5, wherein an annular cooling chamber is provided between said hollow cylindrical body and said transition channel.

8. The delivery device according to claim 7, wherein said annular cooling chamber is integral with the hollow cylindrical body and is provided with a stationary annular circuit therein, the stationary annular circuit comprising at least one delivery pipe provided with nozzles adapted to spray a cooling liquid on an inner wall of said hollow cylindrical body.

9. The delivery device according to claim 8, wherein said stationary annular circuit is provided with a return pipe adapted to take in the cooling liquid from a bottom of the annular cooling chamber.

10. The delivery device according to claim 7, wherein said annular cooling chamber is integral with the hollow cylindrical body, is configured to be filled with a cooling liquid, and is provided with an annular pipe arranged inside said annular cooling chamber, the annular pipe being configured for circulation of a further liquid having a temperature lower than a temperature of said cooling liquid.

11. The delivery device according to claim 1, wherein a lubrication circuit is included to lubricate the first bearing.

12. The delivery device according to claim 11, wherein said lubrication circuit comprises a hose adapted to be fed with a lubricant, the hose crossing the housing and being connected to the first annular body at an end thereof.

13. The delivery device according to claim 11, wherein there is provided an additional lubrication circuit to lubricate a second bearing.

14. The delivery device according to claim 7, wherein the annular cooling chamber occupies an upper part of a space defined between said hollow cylindrical body and said transition channel, and wherein at least a part of the mechanism is accommodated within a lower part of said space.

15. The delivery device according to claim 14, wherein the inner wall of the hollow cylindrical body in said lower part of said space is coated with at least one layer of refractory material.

16. The delivery device according to claim 1, comprising a device for locking the chute comprising a pair of elements adapted to rotate along an axis which is perpendicular to the first axis X so as to abut against the chute.

17. The delivery device according to claim 13, wherein said additional lubrication circuit comprises an opening in a wall of the housing to introduce a lubricant into an additional annular duct adapted to lead the lubricant to the second bearing.

18. The delivery device according to claim 12, wherein said hose is connected, via a rotary joint, to an annular duct inside said first annular body, the annular duct being adapted to lead the lubricant to the first bearing.

* * * * *